United States Patent [19]

Calamari, Jr.

[11] 4,165,396

[45] Aug. 21, 1979

[54] METHOD FOR SALVAGING THE LIGHT-ABSORBING MATRIX AND SUPPORT OF A LUMINESCENT SCREEN

[75] Inventor: James A. Calamari, Jr., Marion, Ind.

[73] Assignee: RCA Corporation, New York, N.Y.

[21] Appl. No.: 917,104

[22] Filed: Jun. 19, 1978

[51] Int. Cl.[2] ..... B05D 3/10; B05D 3/00; B08B 3/08

[52] U.S. Cl. ..... 427/64; 427/68; 427/71; 427/140; 427/341; 427/343; 427/352; 427/353; 427/354; 427/421; 427/427; 134/29

[58] Field of Search ..... 427/64, 68, 71, 40, 427/352-354, 341, 343, 140, 421, 427; 134/29

[56] References Cited

U.S. PATENT DOCUMENTS

| | | | |
|---|---|---|---|
| 2,710,286 | 6/1955 | Zachariason | 252/301.6 R |
| 3,035,909 | 5/1962 | Holt | 51/317 |
| 3,067,055 | 12/1962 | Saulnier | 427/68 |
| 3,558,310 | 1/1971 | Mayaud | 96/36.1 |
| 3,582,389 | 6/1971 | Saulnier | 427/68 |
| 3,582,390 | 6/1971 | Saulnier | 427/68 |
| 3,788,846 | 1/1974 | Mayaud | 96/36.1 |
| 4,049,452 | 9/1977 | Nekut | 427/43 |

*Primary Examiner*—Michael F. Esposito
*Attorney, Agent, or Firm*—E. M. Whitacre; G. H. Bruestle; L. Greenspan

[57] ABSTRACT

In a method for preparing a luminescent screen which includes depositing a light-absorbing matrix upon a support, depositing a phosphor-particle layer on the matrix and support, and then coating the phosphor-particle layer with a film of organic polymeric material, the steps for salvaging the support and matrix substantially undisturbed, while substantially entirely removing the overlying material. In the method, the overlying material is contacted with an alkaline aqueous solution until the organic polymeric film is at least partially solubilized. Then, the overlying material is substantially entirely flushed away.

7 Claims, 1 Drawing Figure

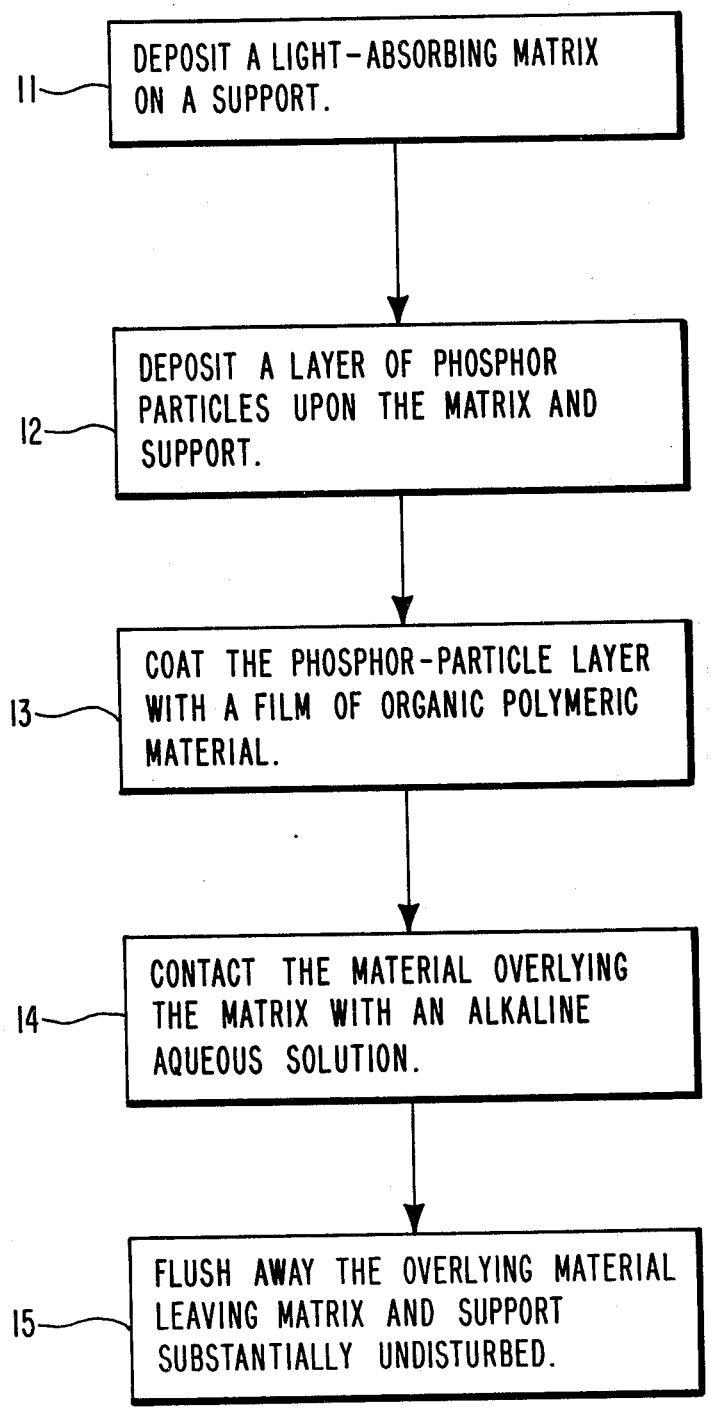
11
DEPOSIT A LIGHT-ABSORBING MATRIX ON A SUPPORT.
12
DEPOSIT A LAYER OF PHOSPHOR PARTICLES UPON THE MATRIX AND SUPPORT.
13
COAT THE PHOSPHOR-PARTICLE LAYER WITH A FILM OF ORGANIC POLYMERIC MATERIAL.
14
CONTACT THE MATERIAL OVERLYING THE MATRIX WITH AN ALKALINE AQUEOUS SOLUTION.
15
FLUSH AWAY THE OVERLYING MATERIAL LEAVING MATRIX AND SUPPORT SUBSTANTIALLY UNDISTURBED.

METHOD FOR SALVAGING THE LIGHT-ABSORBING MATRIX AND SUPPORT OF A LUMINESCENT SCREEN

BACKGROUND OF THE INVENTION

This invention relates to a method for preparing a luminescent viewing screen comprising a light-absorbing matrix on a support; and particularly to a method wherein the supports which have defective in-process screens thereon can be recycled without disturbing the matrix.

Some prior color-television picture tubes include a light-absorbing matrix as a structural part of the luminescent viewing screen. In such tubes, a light-absorbing matrix is supported on the inner surface of the faceplate panel of the tube. The matrix has a multiplicity of openings therein, which may be in the shape of dots or lines, with phosphor filling each opening in the matrix, and with a specular metal layer over the phosphor.

In one sequence of fabrication processes commonly used in the picture-tube industry, the matrix is prepared by reverse printing, as described, for example, in U.S. Pat. Nos. 3,558,310 to E. E. Mayaud and 4,049,452 to E. E. Nekut. After such a matrix is deposited on the inner surface of a panel, a patterned layer of phosphor particles is deposited photographically on the matrix. The phosphor-particle layer is dried and then coated with a film of organic polymeric material as described, for example, in U.S. Pat. Nos. 3,582,389 and 3,582,390, both to T. A. Saulnier. The film is then metallized, usually by vapor depositing aluminum metal thereon.

During the fabrication processes following the deposition of the matrix, some screens are found to be defective. By the prior salvaging method, the entire structure, including the matrix, is stripped from the panel of the tube, and a new screen structure is produced on the salvaged panel. In most cases, the matrix is not defective, and considerable savings can be realized if the matrix can be salvaged with the panel. Attempts have been made to remove the material overlying the matrix by contacting the matrix with oxidizing solutions which are used to develop a matrix. Examples of such oxidizing solutions are disclosed in the Mayaud and Nekut patents cited above. Although most of the overlying material was removed with oxidizing solutions, nevertheless enough material remained to consider the panel and matrix unacceptable for recycling.

SUMMARY OF THE INVENTION

In the novel method, as in the prior art, a light-absorbing matrix is deposited upon a support, a layer of phosphor particles is deposited upon the matrix and support, and the phosphor-particle layer is coated with a film of organic polymeric material. Then, before or after metallizing, but before baking to remove organic material in the screen structure, the film is contacted, as by spraying, with an alkaline aqueous solution until the film material is at least partially solubilized. Then, the material overlying the matrix and support is substantially entirely flushed away. The alkaline solution has a pH in the range of 8.0 to 13.0 and is preferably a solution of ammonium hydroxide, although solutions of an alkali hydroxide or a tertiary amine may be used.

By employing the alkaline solutions according to the novel method, substantially all of the material overlying the matrix and support is removed, while the matrix remains substantially undisturbed. The salvaged matrix and support may now be recycled starting with the deposition of the phosphor-particle layer, resulting in considerable savings in equipment and processing costs.

BRIEF DESCRIPTION OF THE DRAWING

The sole FIGURE is a flow-sheet diagram of the novel method.

DETAILED DESCRIPTION OF THE PREFERRED EMBODIMENT

A luminescent viewing screen is produced on the inner surface of a faceplate panel of a cathode-ray tube as described in the example of U.S. Pat. No. 3,788,846 to E. E. Mayaud et al. This includes depositing a light-absorbing graphite matrix on the surface, depositing a phosphor-particle layer upon the matrix and surface, coating an aqueous emulsion comprising acrylate copolymers on the phosphor layer, drying the emulsion coating to form a film, and then vapor depositing aluminum metal on the film. At this point or before metallizing, the viewing screen is inspected to determine whether it is defective in some respect, such as having a blemish in the phosphor layer, or having too thin, or missing, aluminum, or having entrapped dirt, or having missing phosphor areas, etc. If the screen structure overlying the matrix is found to be unacceptable, and the matrix is acceptable, the film is sprayed with a 5-weight-percent aqueous-ammonium-hydroxide solution, with or without rotation. The panel may be in any orientation but is preferably positioned with the screen facing down. The material overlying the matrix becomes sufficiently solubilized in 5 to 60 seconds. Then, the solubilized screen is flushed with water until all of the material overlying the matrix is removed.

SOME GENERAL CONSIDERATIONS

The sole FIGURE is a flow-sheet diagram of the novel method. The novel method is applied to making luminescent screens for color-television picture tubes especially of the shadow-mask type. However, the invention may be applied to the making of any luminescent viewing screen which includes a phosphor-particle layer on a light-absorbing matrix which has been filmed with an organic polymeric material.

As indicated by the box 11, after the supporting surface for the screen has been cleaned, a light-absorbing matrix is produced thereon. Any of the methods described in the above-cited patents to Mayaud, Mayaud et al, and Nekut may be used. In each of these methods, a photosensitive polymeric film on a support surface is exposed to a light image, whereby it becomes insolubilized selectively in the illuminated areas. The still-soluble portions are washed away, and the retained insolubilized film portions and support surface are coated with particulate graphite or other light-absorbing material. A matrix is now developed by contacting the coating with an oxidizing solution, such as aqueous hydrogen peroxide, to remove the retained film portions and overlying material, while leaving the graphite contacting the support surface undisturbed.

As shown by the box 12, a layer of phosphor particles is deposited on the matrix and support. For example, any of the methods described in the above-cited patents to Mayaud, Mayaud et al and Nekut may be used. In each of these methods, the layer comprises a mosaic of different-color-emitting phosphor areas. Each color is produced photographically by exposing a coating comprising the desired phosphor material and a light-sensitive binder to a pattern of light-insolubilizing radiation, and then developing the pattern by washing away the still-soluble portions of the coating. Alternatively, a tacky binder pattern may be deposited on the matrix and support and phosphor powder adhered to the tacky pattern.

As shown by the box 13, the layer of phosphor particles is coated with a film of organic polymeric material. Any of the methods described in U.S. Pat. Nos. 3,067,055, 3,582,389 and 3,582,390, each issued to T. A. Saulnier, may, for example, be used. In each of these patents, an aqueous emulsion consisting predominantly of film-forming acrylate copolymers is coated on the phosphor-particle layer. The emulsion penetrates into the phosphor-particle layer down to the matrix and support surface. The emulsion coating is dried in such manner as to produce a film. The drying is preferably accompanied by some heating in order to develop a film with a specular surface. After forming the film, for the purposes of the novel method, a specular metal layer may be produced on the film. Then, the structure is baked in air to remove the organic and volatile material in the structure.

After producing the film but prior to baking the structure, for whatever reason, an unacceptable structure may be returned to salvage the matrix on its support surface and to repeat the steps shown in boxes 11 through 13. Normally 10 to 20 percent of the structures are returned for salvaging. To this end, as shown by the box 14, the material overlying the matrix is contacted with an alkaline aqueous solution until the film material is at least partially solubilized. The solution has a pH in the range of about 8.0 to 13.0, and preferably in the range of 10.0 to 12.0. The solution includes one or more materials which form alkaline solutions with water. Some suitable materials are ammonium hydroxide, sodium hydroxide, potassium hydroxide and tertiary amines such as triethanol amine. It is preferred to use ammonium hydroxide solutions containing about 1.0 to 5.0 weight percent $NH_4OH$. The contacting can be achieved by spraying the solution on or flowing the solution over the surface.

The effect of contacting the material overlying the matrix with an alkaline solution is to solubilize the film material. It is believed that the solution penetrates the entire structure and acts selectively on the film material but does not affect the matrix, the support surface or the phosphor particles. The age of the structure after depositing the phosphor layer, the temperatures of the support surface and the solution, and other process variables affect the rate and efficiency of solubilization. It is preferred but not necessary that the structure be at least 24 hours old to effect efficient and rapid solubilization. Solubilization normally occurs in 5 to 60 seconds after the initial contact with the solution.

Wetting the structure with water before, or rinsing the screen after, contacting it with the alkaline solution may benefit the novel method under some conditions, although these steps are not required by the novel method. Generally, it is not necessary for the support or the solution to be heated to elevated temperatures in order to obtain desired results, although the process rate is increased by higher temperatures, and more careful process control may be necessary to insure consistency.

Aqueous solutions of oxidizing materials, such as hydrogen peroxide, which are used to develop the matrix, have been tried but have been found to leave undesirable residues of the film. This is attributed to the fact that these oxidizing solutions act on the binder for the phosphor particles and not on the film material. It is believed that the organic film material adheres to particles of the underlying phosphor layer and to the matrix and the support surface. The film material, which has phosphor particles attached, is not completely removed from the support and matrix by the oxidizing solutions that can be used to develop the matrix. However, and surprisingly in the novel method, after the overlying material is contacted with an alkaline solution which at least partially solubilizes the film material, all or substantially all of the overlying material is removed by simple flushing.

As shown by the box 15, after solubilizing the material overlying the matrix with an alkaline solution, the solubilized material is flushed away leaving a clean, substantially undisturbed matrix and support surface which, after drying, is ready to receive a new phosphor-particle layer. Room-temperature water is adequate for this purpose, although, if desired, it may contain low concentrations of dispersing agents.

I claim:

1. In a method for preparing a luminescent viewing screen including depositing a light-absorbing matrix upon a support, depositing a layer of phosphor particles upon said matrix and support and coating said phosphor-particle layer with a film of organic polymeric material, the steps for substantially entirely removing said phosphor-particle layer and film while leaving said matrix substantially undisturbed, said steps comprising:

(a) contacting said film with an alkaline aqueous solution until said film material is at least partially solubilized, said solution having a pH in the range of 8.0 to 13.0, (b) and then flushing said support with an aqueous medium until said film and phosphor-particle layer are substantially removed.

2. The method defined in claim 1 wherein said solution has a pH in the range of 10.0 to 12.0.

3. The method defined in claim 1 wherein said solution includes as an essential ingredient at least one compound selected from the group consisting of ammonium hydroxide, alkali hydroxides and tertiary amines.

4. The method defined in claim 1 wherein said film consists predominantly of an acrylic material.

5. The method defined in claim 1 wherein said film consists predominantly of acrylate copolymers deposited from an aqueous emulsion thereof.

6. The method defined in claim 5 wherein said solution consists essentially of an aqueous solution of ammonium hydroxide having a pH in the range of 10.0 to 12.0.

7. The method defined in claim 6 wherein said solution is applied to said film by spraying and step (a) lasts for less than one minute.

* * * * *